US005176491A

United States Patent [19]

Houkom

[11] Patent Number: 5,176,491

[45] Date of Patent: Jan. 5, 1993

[54] OVERCENTER BACKHOE APPARATUS

[75] Inventor: Robert L. Houkom, Burlington, Iowa

[73] Assignee: Case Corporation, Racine, Wis.

[21] Appl. No.: 717,029

[22] Filed: Jun. 18, 1991

[51] Int. Cl.[5] ..... E02F 3/28

[52] U.S. Cl. ..... 414/694; 414/722; 414/918

[58] Field of Search ..... 414/687, 694, 695.5, 414/702, 722, 918; 212/182, 238, 266

[56] References Cited

U.S. PATENT DOCUMENTS

| | | | |
|---|---|---|---|
| 3,376,984 | 4/1968 | Long et al. . | |
| 3,390,794 | 7/1968 | McMuller et al. | 414/694 |
| 3,987,914 | 10/1976 | VanDerZyl et al. . | |
| 4,074,821 | 2/1978 | Long . | |
| 4,193,734 | 3/1980 | Williams | 414/694 |
| 4,272,222 | 6/1981 | Davis . | |
| 4,358,240 | 11/1982 | Shumakes | 414/722 X |
| 4,686,782 | 8/1987 | Nagatomo . | |
| 4,715,771 | 12/1987 | Hanson . | |
| 4,720,234 | 1/1988 | Stralow . | |
| 4,735,547 | 4/1988 | Wagner et al. . | |
| 5,004,397 | 4/1991 | Schwappach | 414/694 X |

FOREIGN PATENT DOCUMENTS

| | | | |
|---|---|---|---|
| 255837 | 8/1964 | Australia | 414/695.5 |
| 1484606 | 1/1969 | Fed. Rep. of Germany | 414/694 |
| 57-190842 | 11/1982 | Japan | 414/694 |

OTHER PUBLICATIONS

Case Accent on Loader/Backhoes Product Sheet dated Dec., 1987, J. I. Case Company, Racine, Wis.

Advertisement entitled: "Cat Announces a Boom in Backhoe Loaders", p. 51 of "Equipment Today", Aug. 1990.

Advertisement of Ford 555C Xtra-Vator, p. 142 of "Equipment Today Showcase '90".

*Primary Examiner*—Michael S. Huppert
*Assistant Examiner*—William M. Hienz
*Attorney, Agent, or Firm*—Dressler, Goldsmith, Shore, Sutker & Milnamow, Ltd.

[57] ABSTRACT

A backhoe apparatus with a boom structure which is movable overcenter in a fore-and-aft direction and a boom actuator arranged in fore-and-aft alignment with and protected by lateral sides of the boom structure. A swing tower is connected about a lower pivot axis to a lower end of the boom and allows for lateral swinging movement of the boom. The swing tower allows for overcenter movement of the boom to opposite sides of an upper pivot axis on the swing tower whereat one end of the boom actuator is secured. The boom structure has a curved configuration at its lower end to accommodate nesting of the boom actuator while maintaining torsional rigidity for the boom.

10 Claims, 3 Drawing Sheets

OVERCENTER BACKHOE APPARATUS

FIELD OF THE INVENTION

The present invention generally relates to a backhoe apparatus and, more particularly, to a backhoe apparatus which is adapted to be mounted to a material handling implement such that a boom of the backhoe apparatus is movable overcenter to a transport position to shift the weight of the backhoe apparatus closer to the center of gravity of the implement thereby enhancing balance and handling of the implement.

BACKGROUND OF THE INVENTION

A backhoe apparatus is a particularly versatile piece of equipment which can be used for a wide variety of operations. A conventional backhoe apparatus includes an elongated boom member and dipper arm assembly mounted to a rear of a material handling implement such as a tractor or the like thereby providing mobility for the backhoe apparatus in use while further facilitating transportation of the backhoe apparatus from one location to another.

Bending and torsional loads of great magnitude can be and often are exerted on the boom member and dipper stick assembly during operation of the backhoe apparatus. Thus, it is necessary that the boom member and dipper stick assembly be designed with heavy construction strong enough to withstand substantial loading placed thereon during normal operations of the backhoe apparatus.

The heavy construction of the boom member and dipper stick assembly result in a backhoe apparatus having substantial weight. In that the backhoe apparatus is typically attached to a rear end of the implement, at a position rearward of the rear wheels thereof, there is a natural tendency for the rear wheels of the implement to serve as a fulcrum point about which the weight of the backhoe apparatus tends to rock the implement backwards. Even when the backhoe apparatus is positioned for transport, the main center of gravity for the implement is far to the rear such that implement stability is effected and handling is unduly difficult.

On conventional backhoes, mechanical balance is attempted by placing counterweights on the front of the implement. As will be appreciated, counterweights have the disadvantage of increasing the total weight of the implement and are usually insufficient to overcome inertial movements caused by the shifting weight of the backhoe apparatus as the implement is driven from one location to another.

The elongated boom member of a typical backhoe apparatus has one end mounted to a rear end of the implement for vertical and sideways movements relative thereto. The elongated dipper stick arm is connected toward an opposite end of the boom member. A dipper, or other suitable tool, is typically mounted to the distal end of the dipper stick arm to effect digging or other work operations.

The benefits of moving the backhoe apparatus into a transport position whereat the boom member is raised to a generally vertical orientation and the dipper is folded in as close as possible to the boom were recognized early on by J. I. Case Company. Although this concept advantageously brought the center of gravity of the backhoe apparatus closer to the implement, the main center of gravity of the implement, relative to the rear wheels, continued to be a problem and implement handling remained somewhat unstable.

In responding to these problems, J. I. Case Company has for many years provided a backhoe apparatus having an advantageous overcenter design. Such a backhoe apparatus includes a generally U-shaped swing tower having a linear boom member pivotally connected about a lower pivot axis on the swing tower. The swing tower is connected to the implement for lateral swinging movement allowing the boom member, dipper arm, and dipper to move sideways relative to the implement. In early J. I. Case designs, a pair of outboard boom cylinders attach to and flank the boom member and connect to an upper pivot axis on the swing tower. The swing tower is configured such that when the backhoe apparatus is moved from a transport position to an operating position, the linear boom member is vertically moved from one side of the upper pivot axis to an opposite side of the pivot axis. In the transport position, the boom member is allowed to swing somewhat downwardly and toward the implement. The ability of the boom member to assume a more forwardly inclined relationship enhances the position of the main center of gravity for the implement thereby providing better balance and handling characteristics therefor.

Arranging the boom cylinders on opposite lateral sides of the boom member, however, has certain operational drawbacks. With the boom cylinders arranged in flanking relationship relative to the boom member, they are exposed for possible damage when the backhoe apparatus is laterally moved sideways relative to the implement. Moreover, with the boom cylinders arranged in flanking relationship relative to the boom member, they can limit the working depth obtainable by the backhoe apparatus by adversely interfering with the vertical reach or movement of the boom member beneath surface levels. As will be appreciated visibility is also adversely affected by disposing the cylinders in flanking relationship relative to the boom member in that the effective width of the boom is widened thereby hindering visibility directly rearward of the boom.

The advantages of being able to move the boom member of a backhoe apparatus overcenter were recognized in the industry and likewise embodied in later J. I. Case Company designs. In more recent J. I. Case Company backhoe apparatus designs, the boom member consists of two laterally spaced apart boom sections. The laterally spaced apart boom sections make it possible to use a single boom cylinder which is mounted between the boom sections. As in earlier designs, overcenter forward movement of the boom provides a stable transport configuration for the backhoe apparatus.

Providing two outboard boom sections in flanking relationship to the boom cylinder, however, substantially enlarges the width of the boom. The enlarged boom width requires a larger swing tower for pivotally securing the boom to the implement. The increase in boom width furthermore hinders visibility to work areas directly behind the boom through the opening provided between the boom sections. Moreover, due to the position of the cylinder and reduced size and shape of the two boom sections, the effective cross-sectional configuration of the boom is limited in torsional rigidity. Limiting torsional rigidity of the boom, of course, likewise limits effectiveness and capacity of the backhoe apparatus to handle the substantial loading placed on the backhoe apparatus during normal operations.

Thus, there is a need and a desire for an overcenter backhoe apparatus which protects the boom cylinder from damage without limiting working depth while providing torsional rigidity for the boom to enhance performance characteristics of the backhoe apparatus.

SUMMARY OF THE INVENTION

In view of the above, and in accordance with the present invention, there is provided a backhoe apparatus including a unitary boom structure which is movable overcenter in a fore-and-aft direction and a boom actuator arranged in general fore-and-aft alignment with and protected by lateral sides of the boom. The backhoe apparatus further includes a swing tower connected about a lower pivot pin to a lower end of the boom structure and designed to allow for lateral movement of the backhoe apparatus about a generally vertical axis. One end of the boom actuator is connected to an upper pivot axis on the swing tower. The swing tower is designed to accommodate overcenter movement of the boom structure when moved between a transport position and an operational position. In the transport position, the boom structure is moved forwardly of its true vertical position to advantageously shift the center of gravity thereof during transport. To operate the backhoe apparatus, the boom actuator is effective to move the boom rearwardly of its true vertical position to allow the backhoe to be operated.

To provide torsional rigidity, the unitary boom structure has a generally closed and hollow cross-sectional configuration for a majority of its length. In a preferred form, the boom structure has a generally rectangular cross-sectional configuration which offers strong resistance to torsional loads placed thereon during operation of the backhoe apparatus.

Unlike earlier Case designs, the boom actuator of the present invention includes a single extensible and retractable cylinder arranged in fore-and-aft alignment with and protected against damage by opposite lateral sides of the boom structure. To maintain torsional rigidity for the boom structure, and in contrast to recent Case designs, the cylinder lies outside the cross-sectional configuration of the boom. Fore-and-aft alignment between the boom structure and the boom cylinder furthermore facilitates visibility. This is especially important when using single point tools and extremely narrow backhoe buckets or dippers.

Another feature of the present invention is the ability of the hydraulic actuator to nest between opposite lateral sides of the boom structure outside of the hollow cross-sectional configuration thereby retaining torsional rigidity for the boom. An arcuate or curved configuration at a lower end of the boom structure facilitates accommodation of the actuator while minimizing the distance the lower pivot axis is spaced from the vertical axis of the swing tower.

In a preferred form of the invention, hydraulic conduits pass within the hollow cross-section of the boom to supply oil or other forms of fluid to the actuators. As will be appreciated, passing the conduits within the boom protects the conduits against damage and improves the appearance of the backhoe apparatus as a whole.

According to the present invention, the swing tower or support for the boom comprises a cradle-like structure defining a U-shaped channel in which the boom is nestable. The cradle-like structure of the swing tower is configured to permit movement for the boom to opposite sides of an overcenter position. When the boom is moved overcenter and into a transport position, extension of the boom actuator effects positive locking of the boom in the transport position.

In one version of the present invention, the swing tower is mounted to a rear end of the frame of a material handling implement for lateral movement about a generally vertical axis. The boom is connected toward a lower end to and is vertically pivotable about the lower pivot axis of the swing tower. A dipper stick assembly is connected toward an opposite end of the boom. In response to movement of the backhoe apparatus between a transport position and an operative position, the boom is movable through a neutral intermediate position to opposite sides of the upper pivot axis defined on the swing tower.

One end of the boom actuator is connected to the upper pivot axis on the swing tower. In one form of the invention, the upper and lower pivot axes of the swing tower are in general vertical alignment relative to each other. The preferred arcuate or curved configuration at the lower end of the boom facilitates spacial accommodation of the lower end of the boom actuator while minimizing the distance separating the lower pivot axis of the boom from the implement thereby improving balance and handling characteristics of the implement.

An opposite end of the boom actuator is connected to bracket means arranged proximate midlength of the boom. Another selectively operable actuator is likewise connected to the bracket means by a common connector. This second actuator selectively operates the dipper stick assembly connected to an opposite end of the boom.

In a fully raised or transport position, the boom leans forwardly or overcenter thus advantageously shifting the weight of the backhoe apparatus toward the center of gravity of the implement thereby enhancing stability and implement handling characteristics. Because of the fore-and-aft alignment between the actuator and the boom, visibility to the work area is improved. Moreover, providing the boom with a curved configuration at its lower end facilitates nesting of the actuator between lateral sides of the boom without sacrificing torsional rigidity and in a manner minimizing the distance separating the lower pivot axis of the swing tower from the implement.

Numerous other features and advantages of the present invention will become readily apparent from the following detailed description, the accompanying drawings, and the appended claims.

DETAILED DESCRIPTION OF THE INVENTION

Figure 1:
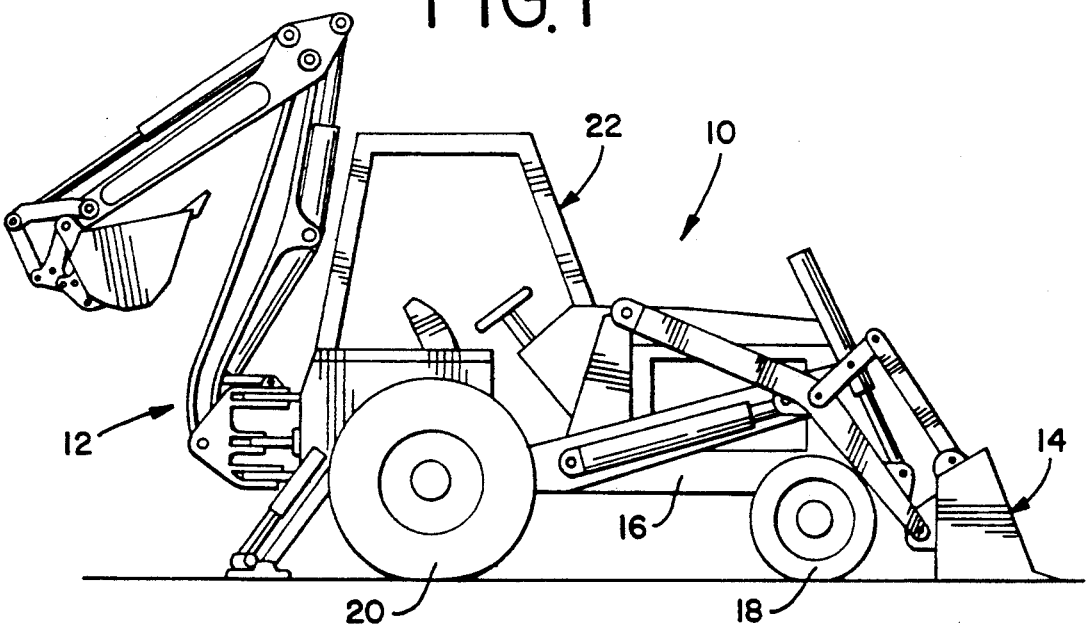
FIG. 1 is a side elevational view of a material handling apparatus with a backhoe apparatus embodying principals of the present invention attached to a rear end thereof.

While the present invention is susceptible of embodiments in various forms, there is shown in the drawings a preferred embodiment hereinafter described with the understanding that the present disclosure is to be considered as an exemplification of the invention, and is not intended to limit the invention to the specific embodiment illustrated.

Referring now to the drawings, wherein like reference numerals indicate like parts through the several views, there is shown in FIG. 1 a material handling implement 10 with a backhoe apparatus 12 attached for operation at the rear end thereof. At a forward end thereof, the implement is typically provided with a conventional loader 14. In the illustrated embodiment, implement 10 is shown as a tractor, but it will be appreciated that the backhoe apparatus may be secured to other types of implements without detracting from the spirit and scope of the present invention. As shown, the implement 10 includes a fore-and-aft extending frame 16 supported for movement by front and rear pairs of wheels 18 and 20, respectively. An operator station or cab 22 provides a central location for controls (not shown) which operate the implement 10 and the backhoe apparatus 12.

Figure 2:
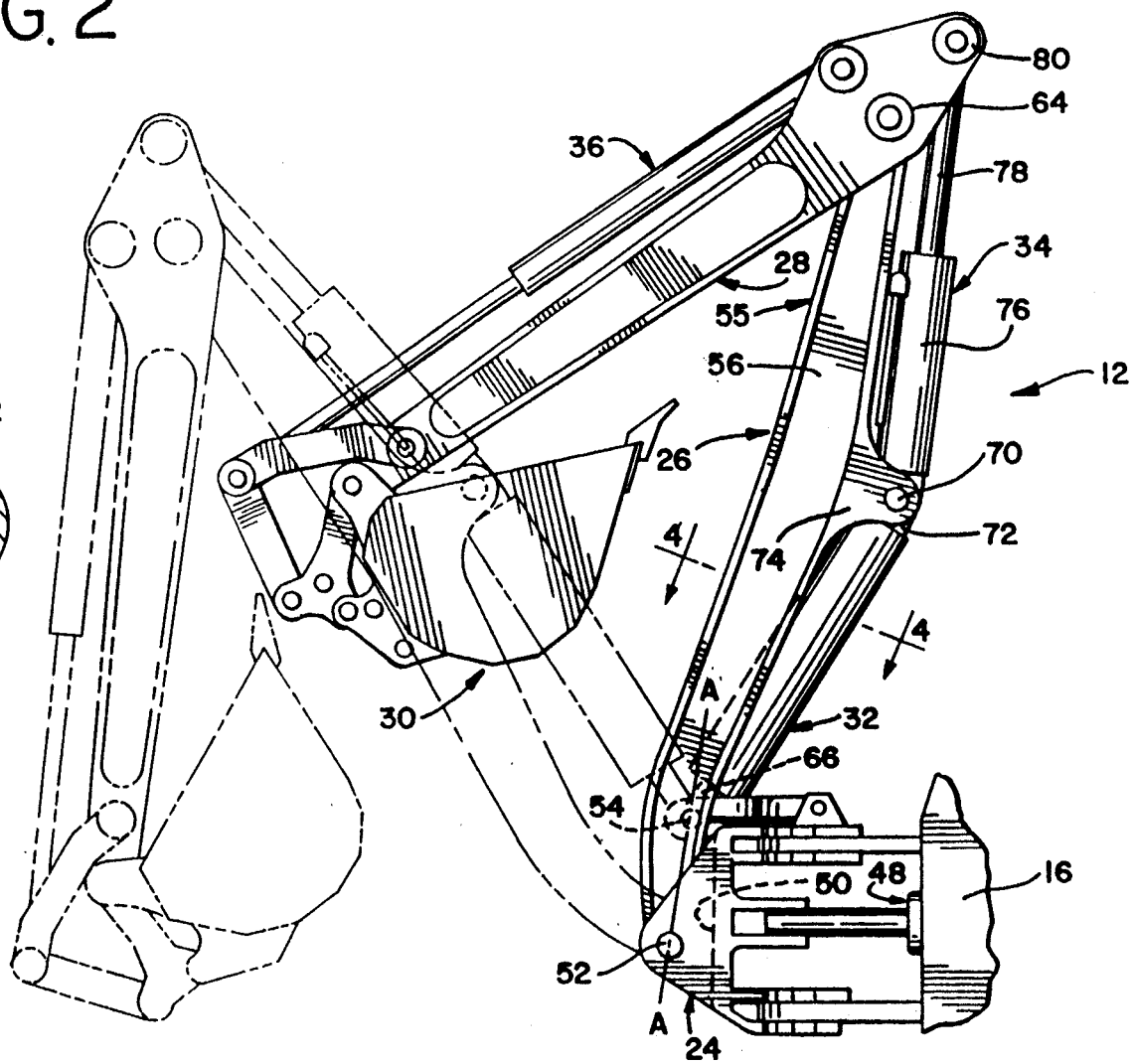
FIG. 2 is an enlarged side elevational view of the backhoe apparatus of the present invention represented in solid lines the parts in a transport position and with phantom lines representing the parts of the backhoe apparatus in an operating position.

Turning to FIG. 2, the backhoe apparatus 12 includes a support attachment 24, an elongated boom assembly 26 pivotally connected to the support attachment 24, a dipper stick assembly 28 connected to an upper end of the boom assembly 26, and a dipper or bucket element 30 arranged toward a free end of the dipper stick assembly 28. A single boom cylinder assembly 32 effects vertical pivotal movement of the boom assembly. A single dipper stick cylinder 34 effects swinging movement of the dipper stick assembly 28. A single fluid ram 36 operates the dipper or bucket 30 arranged at the distal end of the dipper stick assembly 28.

Figure 3:
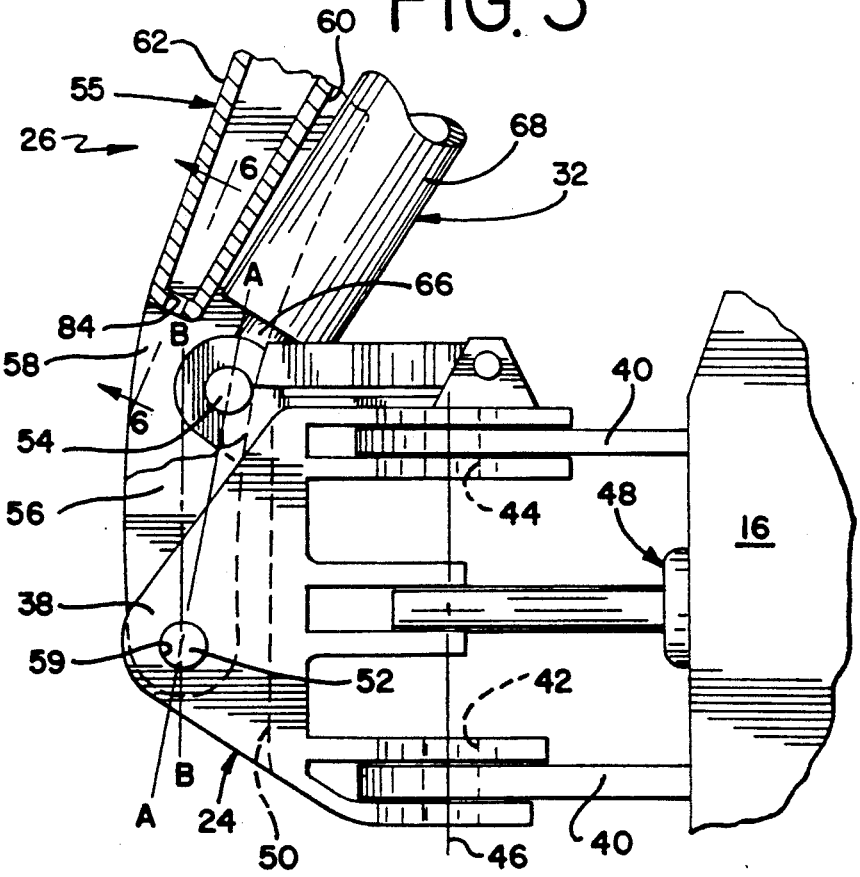
FIG. 3 is an enlarged side elevational view, partially broken away, showing a lower end of the backhoe apparatus of the present invention.

Turning to FIG. 3, the support attachment 24 is in the form of a swing tower 38 pivotally mounted to brackets 40 extending from the back of the implement frame 16. As shown, tower 38 is mounted to the frame 16 by means of lower and upper axially aligned swivel pins 42 and 44, respectively, which allow for lateral movement of the swing tower 38 and the remainder of the backhoe apparatus 12 about a generally vertical pivot axis 46. A swing cylinder assembly 48 positions the swing tower 38 about the pivot axis 46.

The swing tower 38 is configured as a cradle-like structure defining a U-shaped channel 50 in which the lower end of the boom assembly 26 is nested. According to the present invention, the swing tower 38 defines a lower generally horizontal pivot shaft 52 pivotally mounting a lower end of the boom assembly 26 thereto and an upper generally horizontal pivot shaft 54 pivotally securing one end of the boom cylinder assembly 32 thereto. Notably, the lower and upper pivot shafts 52 and 54, respectively, define lower and upper pivots of the swing tower. In a preferred form, the upper pivot shaft 54 is arranged slightly forward of the lower pivot shaft structure 52.

The boom assembly 26 has an elongated boom 55 of unitary construction and includes a mounting section arranged at that end of the boom assembly connected to the swing tower 38 and a main section extending contiguous with and from the mounting section for a majority of the boom assembly length. According to the present invention, the boom 55 has a generally closed and hollow cross-sectional configuration for a majority of its length.

Figure 4:
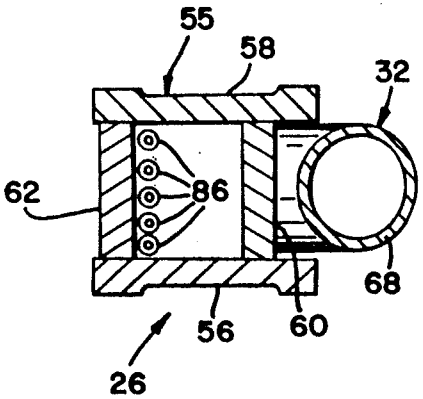
FIG. 4 is a sectional view taken along line 4—4 of FIG. 2.

As illustrated in FIG. 4, the unitary boom structure 55 preferably has a generally rectangular cross-sectional configuration to enhance torsional rigidity for the boom assembly. In the preferred embodiment, the boom 55 has laterally spaced side walls 56 and 58 which are rigidly joined to each other by front and rear walls 60 and 62, respectively.

The mounting section of the boom 55 is formed by an extension of the side walls 56 and 58 and defines laterally aligned apertures 59 extending therethrough. The mounting section of boom 55 is cradled within channel 50 and is hinged to the bottom end of the swing tower 38 by pin 52. As shown in FIG. 2, the dipper stick assembly 28 is pivotally attached as by a suitable pin 64 to the other end of boom 55.

The boom cylinder assembly 32 or boom actuator is preferably arranged on a forward side and in general fore-and-aft alignment with the boom 55. The boom cylinder assembly 32 is preferably of a double-acting type and has a piston rod portion 66 and a cylinder portion 68. As shown, the piston rod portion 66 is pivotally connected to the upper pivot of swing tower 38 by pin 54.

As shown in FIG. 4, the cylinder portion 68 of cylinder 32 is in general fore-and-aft alignment with and between the sidewalls 56 and 58 of boom 55, thereby enhancing visibility for the operator toward a distal end of the backhoe apparatus. Moreover, the side walls 56 and 58 protect the cylinder portion 68 of assembly 32 against damage when the boom assembly 26 is moved in a sideways direction about pivot axis 46. Although arranged in fore-and-aft alignment with boom assembly 26, and as shown in FIGS. 3 and 4, the cylinder portion 68 is arranged forwardly of the forward wall 60 of the boom 55. Arranging the cylinder portion 68 forwardly of wall 60 of boom 55 maintains the cylinder assembly 32 "outside" of the hollow cross-sectional configuration of the boom assembly and thereby retains torsional rigidity for the boom assembly.

According to the present invention, boom 55 has a rearwardly curved configuration toward that end of the boom assembly connected to the swing tower 38. As will be appreciated, the curved configuration of the boom 55 facilitates accommodation of the cylinder portion of cylinder assembly 32 between the sidewalls 56 and 58 of boom 55 while minimizing the fore-and-aft distance between pivot 52 and the rear of the implement frame. As will be appreciated, allowing the cylinder assembly 32 to nest or be accommodated between the sidewalls 56 and 58 while maintaining the hollow rectangular configuration for the boom structure 55 to extend lengthwise closer to the pivot 52 enhances torsional rigidity for the boom assembly.

Figure 5:
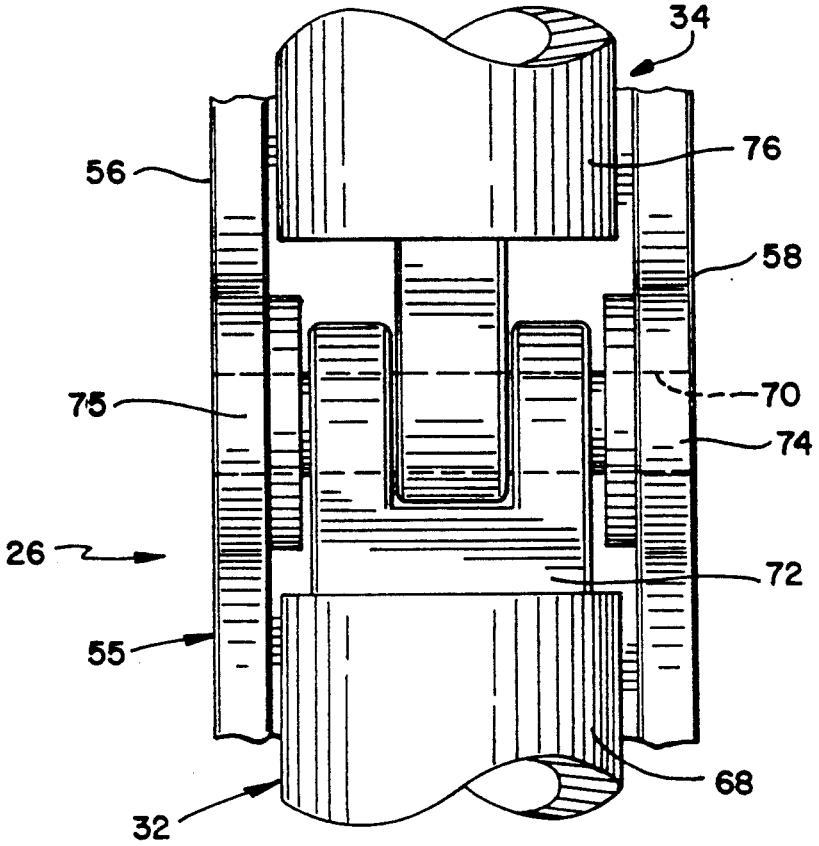
FIG. 5 is a rear view of a mid-length portion of the backhoe apparatus.

As shown in FIGS. 2 and 5, the opposite end of cylinder portion 68 of cylinder assembly 32 is connected to the boom 55 by means of a bracket arranged about or proximate to mid-length thereof. A pivot pin 70 passes through a clevis 72 on the cylinder portion 68 and is secured to the bracket which in the illustrated embodiment includes upstruck ear portions 74 and 75 outwardly extending from boom 55.

The dipper stick cylinder 34 is used to swing the dipper stick assembly 28 about pivot 64. As shown in FIG. 2, cylinder 34 is also of the double acting type and includes a cylinder portion 76 with a retractable and extensible piston rod portion 78 extending therefrom. The piston rod portion 78 is connected to the dipper stick assembly by a suitable pivot shaft 80 arranged in spaced relation from the pivot 64. The cylinder portion 76 of cylinder 34 is connected to the boom 55. As shown in FIG. 5, pin 70 acts as a common connector for the cylinders 32 and 34.

Figure 6:
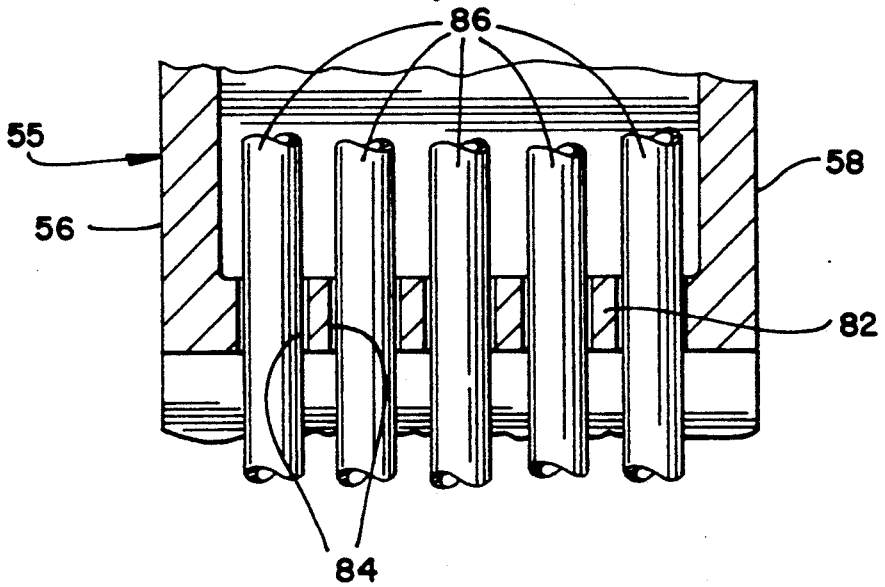
FIG. 6 is a sectional view taken along line 6—6 of FIG. 3.

Turning now to FIG. 6, the hollow cross-sectional configuration of boom 55 is closed toward a lower end by a web 82 laterally extending between side walls 56 and 58 of boom 56. Web 82 may have a series of side-by-side apertures or passages 84 extending into the hollow interior of boom 56. A series of flexible conduits 84 pass through the apertures 86 for directing pressurized fluid to the cylinder assemblies used to control operation of the backhoe apparatus.

In operation of the backhoe apparatus, sideways or lateral movement of the boom 55 and associated parts is effected through extension and retraction of the swing cylinder assembly 48 thereby moving the swing tower 38 about the generally vertical pivot axis 46. Forward and rearward movement of the boom 55 and associated parts is effected in a conventional manner as by extension and retraction of actuators 32, 34 and 36. Notably, however, boom 55 is permitted to operate more nearly toward a true vertical position to maintain the center of the backhoe apparatus closer to the implement 10 thereby improving the balance and handling characteristics thereof.

During operation, and as shown in FIG. 2, the unitary boom structure 55 of the backhoe apparatus is vertically moved about the lower pivot axis 52. When the backhoe is swung from the phantom position of FIG. 2 to the solid line position of FIG. 2, hydraulic pressure is applied to retract the cylinder assembly 32 thereby raising the unitary boom 55 toward a neutral position indicated in FIG. 2 by line A—A wherein the pivot axes 52 and 54 are in line with the line of action of the boom cylinder assembly 32.

The forward momentum of the backhoe apparatus enables the boom 55 to continue through the neutral position toward the solid line position of FIG. 2. After the boom 55 moves overcenter, whereat the pivot axes 52 and 54 are in line with the line of action of the boom cylinder assembly 32, hydraulic pressure is applied to extend the cylinder assembly 32 to assist forward travel of the unitary boom between the neutral position and the transport position illustrated in solid lines in FIG. 1. Thereafter, application of the hydraulic pressure to extend the cylinder assembly 32 effects a knee lock on the boom to hold the backhoe in the transport position.

As shown in FIG. 3 and as will be appreciated, arranging the pivot axis 54 slightly forward of pivot axis 52 arranges the neutral position for the boom indicated by line A—A slightly forward of a true vertical position as schematically indicated by line B—B and provides more positive control of assisting overcenter movement of the boom 55. That is, allowing the boom to move overcenter or past the neutral position indicated by line A—A and toward a transport position requires further action by the cylinder assembly 32 to assist the final forward increment of travel of the boom 55.

To shift the backhoe from the solid line position of FIG. 2 to the phantom position of FIG. 2, hydraulic pressure is applied to retract the boom actuator 32 to initiate rearward vertical swinging movement of the boom 55 about the pivot axis 52 and toward the neutral position. The bucket actuator 36 is operated at the same time to curl the bucket 30 rearwardly, thereby abruptly shifting the center of gravity rearwardly and thereby assisting in the rearward launch of the boom overcenter and to an opposite side of the upper pivot axis 54. When the parts move past the neutral position, the hydraulic pressure is applied to extend the boom cylinder thereafter vertically positioning the boom as desired.

Notably, a single boom actuator 32 is used to move the boom structure 55 between a transport position and an operating position. Arranging the cylinder assembly 32 forwardly of and in fore-and-aft alignment with the boom 55 thereby enhances visual access past the boom 55 toward the bucket 30 or other suitable implement. Because of its alignment with boom 55, the boom cylinder assembly 32 is protected by the side walls 56 and 58 of the boom thereby inhibiting damage upon sideways or lateral movement of the boom.

The unitary boom structure 55 has a generally hollow cross-sectional configuration which maximizes torsional rigidity for the backhoe apparatus. The curved configuration at the lower end of boom 55 facilitates extension of the hollow cross-sectional boom configuration in close proximity to the lower pivotal connection to the swing tower 38 while allowing the cylinder assembly 32 to remain outside of the effective cross-sectional area of the boom 55. Notably, the curved configuration of the boom furthermore facilitates accommodation of the actuator 32 in fore-and-aft alignment with the boom while minimizing the distance between pivot axis 52 of the swing tower 38 and the rear end of the implement. As will be appreciated, minimizing the distance that the lower pivot 52 is spaced from the implement enhances the weight distribution of the backhoe apparatus relative to the implement.

The provision of a boom having a hollow cross-section furthermore allows the hydraulic conduits 84 to extend upwardly through the hollow cross-section. Extending the conduits 84 through the hollow cross-section of the boom protects the conduits against damage by limiting their exposure and furthermore enhances aesthetics of the boom assembly. Moreover, the use of a single boom actuator cylinder assembly 32 reduces the number of hydraulic lines required for the backhoe apparatus. Use of a single boom cylinder assembly furthermore reduces the overall weight of the backhoe apparatus while still retaining the overcenter feature discussed above thereby enhancing operation of the backhoe apparatus.

From the foregoing, it will be observed that numerous modifications and variations can be effected without departing from the true spirit and scope of the novel concept of the present invention. It is to be understood that no limitation with respect to the specific embodiment illustrated is intended or should be inferred. The disclosure is intended to cover by the appended claims all such modifications as fall within the scope of the claims.

What is claimed is:

1. A backhoe apparatus comprising:

a swing tower having upper and lower generally horizontal pivot pins and means allowing for lateral movement of the swing tower about a generally vertical axis;

a boom connected at one end to said swing tower for vertical movement and being comprised of a mounting section arranged at that end of the boom connected to the swing tower and a main section extending from said mounting section, said mounting section serving to pivotally mount said boom to the lower pivot pin of said swing tower such that said boom is adapted to move forwardly and rearwardly of its true vertical position, with said main section of said boom having a hollow generally rectangular cross-sectional configuration including laterally spaced sidewalls;

a double acting boom cylinder assembly including a selectively extensible and retractable cylinder connected to the main section on a forward side of the boom and to the upper pivot pin to effect forward and rearward movement of said boom relative to a true vertical position of the boom and about said lower pivot pin, said cylinder being mounted forwardly of said main section and between the sidewalls of said boom to minimize boom width thereby maximizing visibility thereabout in a fore-and-aft direction while remaining outside the hollow cross-section of the boom; and wherein the mounting section of said boom has a rearwardly curved configuration extending from that end of the boom connected to said swing tower and accommodating positioning of the cylinder, the curved configuration of the boom allowing the generally rectangular cross-sectional configuration of the main section to extend proximate to the lower pivot axis thereby promoting torsional rigidity for the boom while maintaining the cylinder in general alignment with the boom.

2. The backhoe apparatus according to claim 1 wherein said swing tower comprises a cradle-like structure defining a channel in which the mounting section of said boom is nestable.

3. The backhoe apparatus according to claim 2 wherein said cradle-like structure of the swing tower is configured to permit movement of the boom forwardly of its true vertical position and such that the boom cylinder effects positive locking of the boom against the swing tower.

4. A backhoe apparatus comprising:

a support defining upper and lower generally horizontal pivot means and having means allowing for lateral movement of the support about a generally vertical axis;

a unitary boom connected to the lower pivot means of the support for vertical movement in a fore-and-aft direction when moved between a transport position whereat the boom is arranged forwardly of a true vertical position to advantageously shift the center of gravity thereof during transport and an operational position whereat the boom is arranged rearwardly of a true vertical position, said boom having a generally closed and hollow cross-sectional configuration for a majority of its length;

boom actuator means including an extensible and retractable hydraulic actuator connected to a forward side of said boom and to the upper pivot means of said support to effect pivotal movement of and selectively position said boom about said lower pivot means, said hydraulic actuator being generally in fore-and-aft alignment with said boom and protected by opposite lateral sides of the boom while remaining outside of the hollow cross-sectional configuration thereof thereby retaining torsional rigidity for the boom; and wherein said boom has a rearwardly curved configuration extending from an end connected to the lower pivot means of said support, said curved configuration of the boom accommodating positioning of the hydraulic actuator on the forward side of the boom while allowing the closed hollow cross-sectional configuration of the boom to extend proximate to that end connected to the support thereby enhancing strength characteristics of the boom without adding significant weight thereto.

5. The backhoe according to claim 4 further including conduit means passing within the hollow cross-section of the boom for supplying hydraulic fluid to said hydraulic actuator.

6. The backhoe according to claim 4 further including a dipper stick assembly pivotally connected to said boom.

7. An apparatus for mounting a hydraulically positionable backhoe to a fore-and-aft extending frame of a material handling implement, said apparatus comprising:

a swing tower mounted to a rear end of said frame for lateral movement about a generally vertical axis, said swing tower defining upper and lower generally horizontal pivot an elongated boom connected at a first end and pivotable about said lower pivot pin, said boom having a generally rectangular and essentially hollow cross-sectional configuration and being movable forwardly of a true vertical position to advantageously position the center of gravity of the material handling implement when the backhoe is in a transport position and rearwardly of its true vertical position when the backhoe is in an operative position;

a dipper stick assembly pivotally connected at a second end of said elongated boom;

a first selectively extensible and retractable hydraulic fluid actuator connected to bracket means arranged about midlength on a forward side of said boom and to said dipper stick assembly to effect movement of said dipper stick assembly about a pivotal connection to said boom;

a second selectively extensible and retractable hydraulic fluid actuator connected to said bracket means and to the upper pivot pin of said swing tower to effect movement of said boom about said lower pivot pin to either side of its true vertical position, said second fluid actuator being arranged between and protected by opposite lateral sides of the boom and positioned forwardly outside the hollow cross-sectional configuration of the boom when the backhoe is arranged in a transport position; and wherein said boom has a rearwardly curved configuration extending from the end of the boom connected to said swing tower and accommodating the second fluid actuator on the forward side while maintaining a hollow cross-sectional configuration for a majority of the length of the boom thereby retaining boom strength without sacrificing weight and minimizing the distance separating the lower pivot axis of the swing tower from the material handling implement frame.

8. The mounting apparatus according to claim 7 wherein said first and second actuators are each connected to said bracket means by a common connector.

9. The mounting apparatus according to claim 7 wherein said swing tower comprises a cradle-like structure defining a channel in which the first end of said boom is nested, said channel being configured to allow the boom to move forwardly to shift the weight of the backhoe closer to the center of gravity of the implement when the backhoe is moved to a transport position and to enable actuation of said second actuator to effect a knee lock hold of said boom against said swing tower thereby positively locking the backhoe in a transport position.

10. The mounting apparatus according to claim 9 wherein said first and second actuators are arranged on the same side of said boom in general lateral alignment relative to each other.

* * * * *

UNITED STATES PATENT AND TRADEMARK OFFICE

CERTIFICATE OF CORRECTION

PATENT NO. : 5,176,491
DATED : January 5, 1993
INVENTOR(S) : Robert L. Houkom

It is certified that error appears in the above-indentified patent and that said Letters Patent is hereby corrected as shown below:

Column 10, Claim 7, line 25, after "pivot" insert -- pins; --;

Column 12, Claim 10, line 4, "9" should be -- 7 --.

Signed and Sealed this

Thirtieth Day of November, 1993

*Attest:*

*Attesting Officer*

BRUCE LEHMAN

*Commissioner of Patents and Trademarks*